US006315920B1

(12) United States Patent
Kent et al.

(10) Patent No.: US 6,315,920 B1
(45) Date of Patent: Nov. 13, 2001

(54) ELECTRICAL INSULATING OIL WITH REDUCED GASSING TENDENCY

(75) Inventors: Christopher Jeffrey Still Kent; Jacob B. Angelo, both of Baton Rouge, LA (US)

(73) Assignee: Exxon Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/393,515

(22) Filed: Sep. 10, 1999

(51) Int. Cl.[7] ..... C09K 5/00

(52) U.S. Cl. ..... 252/73; 252/401; 252/399; 208/58; 208/89; 208/92; 208/264; 508/281; 508/280; 508/584

(58) Field of Search ..... 252/50, 51.5 R, 252/52 R, 47.5 R, 399, 401; 208/58, 89, 92, 264; 508/281, 280, 584

(56) References Cited

U.S. PATENT DOCUMENTS 5,167,847 12/1992 Olavesen et al. ..... 252/50

FOREIGN PATENT DOCUMENTS 0170054 1/1990 (EP) .
0497467 8/1992 (EP) .
0499359 8/1992 (EP) .
9302165 2/1993 (EP) .
1215001 12/1970 (GB) .

*Primary Examiner*—Mark Kopec
*Assistant Examiner*—D G H
(74) *Attorney, Agent, or Firm*—Joseph J. Allocca

(57) ABSTRACT

An electrical oil having reduced gassing tendency includes a major amount of a paraffinic or naphthenic basestock and a blend of certain hindered phenols, especially a blend of 2,6-di-t-butyl phenol and 2,6-di-t-butyl cresol. A further enhanced gassing tendency can be provided to the electrical oil by including a tolyltriazole derivative.

6 Claims, No Drawings

ELECTRICAL INSULATING OIL WITH REDUCED GASSING TENDENCY

FIELD OF INVENTION

This invention relates generally to electrical and transformer oils and more particularly to a method for reducing the gassing tendency of paraffinic and naphthenic based electrical oils or mixtures of same.

BACKGROUND OF INVENTION

Electrical insulating oils are formulated so that they may meet or exceed certain specific, performance conditions. These conditions include a minimum pour point, a maximum kinematic viscosity and enumerated limits on interfacial tension, impulse breakdown strength, gassing tendency and levels of acid number and sludge produced in oxidation tests.

Current commercial practice is to use naphthenic distillates as the basestock for electrical insulating oils. Typically the basestock is combined with an effective amount of an antioxidant additive, commonly a hindered phenol. Examples of such antioxidants include 2,6di-t-butyl phenol and 2,6-di-t-butyl cresol. Use of oxidation inhibitors, however, is limited. ASTM D3487 describes Type I oils as being restricted to a maximum of 0.08 wt % oxidation inhibitor and Type II oils, 0.3 wt % inhibitor.

As electrical equipment manufacturers develop more efficient electrical devices there will be a need for electrical oils that have better oxidation resistance than the current oils based on naphthenic basestocks. Higher oxidation resistance can be achieved by use of paraffinic basestocks; however, paraffinic basestock exhibit what is referred to as a positive gassing. The gassing tendency of an oil is a measure of the rate at which hydrogen gas is either evolved or absorbed in an insulating medium when that medium is subjected to electrical stress sufficient to cause ionization. A positive gassing tendency indicates that hydrogen gas is given off, while a negative gassing tendency indicates that hydrogen gas is absorbed. A negative gassing tendency, or very low positive tendency, is desirable since it will minimize the build-up of hydrogen gas which could react with oxygen in the presence of a discharge spark to cause an explosion in the electrical device. Insulating oils shown to have gas absorbing characteristics have been used to advantage in reducing equipment failure, particularly in cables and capacitors.

The gassing tendency of electrical oils is measured by test method ASTM D 2300. Oils that evolve hydrogen gas have a positive test value and those that absorb hydrogen gas have a negative test value.

SUMMARY OF INVENTION

The present invention is based on the discovery that a blend of certain hindered phenols is capable of reducing the gassing tendency of paraffinic or naphthenic basestocks.

Thus, in one embodiment there is provided an electrical oil comprising a major amount of a paraffinic or naphthenic basestock having a viscosity greater than about 5 cSt @ 40° C., preferably 5 cSt to 1000 cSt @ 40° C., and a minor amount of at least one hindered phenol represented by formula I and at least one hindered phenol represented by formula II

I

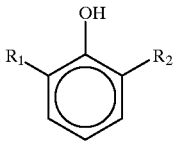

II

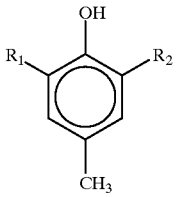

where $R_1$ and $R_2$ may be the same or different alkyl groups, especially branched alkyl groups, containing 3 to about 9 carbon atoms and wherein the weight ratio of phenols of formula I and II is in the range of 1:10 to 10:1. Preferably the phenols of formula I and II are present in an amount greater than about 0.5 wt % based on the weight of the oil.

In another embodiment, the composition of the invention includes a minor amount of a tolyltriazole metal deactivator.

In yet another embodiment, a method for reducing the gassing tendency of a paraffinic or naphthenic electrical oil comprises adding to the oil at least one phenol of formula I and at least one phenol of formula II in the weight ratio of 1:10 to 10:1,the combined phenols being greater than about 0.5 wt % based on the weight of the oil.

DETAILED DESCRIPTION OF THE INVENTION

The composition of the present invention utilizes a major amount of a paraffinic or naphthenic oil with a viscosity greater than about 5 cSt at 40° C. and preferably from about 5 cSt to about 1000 cSt at 40° C. Especially preferred is a paraffinic oil. Typically the paraffinic oil is one having a viscosity of about 25 cSt to 150 cSt at 40° C. In general the oil also will have a pour point in the range of about −50° C. to about −15° C. Examples of such oils are solvent refined paraffinic basestocks with a viscosity of about 30 cSt at 40° C. such as Solvent Neutral 145 and a hydrotreated paraffinic base stock with a viscosity of about 25 cSt at 40° C such as EHC 45, both of which are sold by Exxon Corporation, Irvine, Tex.

The composition of the present invention also includes at least one phenol represented by formula I

I

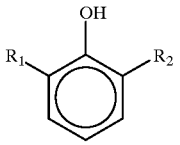

and at least one phenol represented by formula II

II

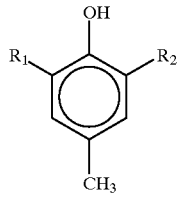

where $R_1$ and $R_2$ may be the same or different alkyl groups, especially branched alkyl groups, containing 3 to about 9 carbon atoms. Preferably in the above phenols $R_1$ and $R_2$ are tertiary butyl groups.

The amount of the combined phenols of formula I and II are generally present in the composition in a minor amount but typically greater than about 0.5 wt %, and preferably from about 1.0 to about 1.5 wt % based on the weight of the oil. The weight ratio of phenols of formula I to formula II generally will range from 1:10 to 10:1 and preferably 1:1 to 1:1.5.

A particularly preferred electrical oil composition comprises a major amount of a paraffinic or naphthenic oil and about 0.1 to 3.0 wt % of 2,6-di-t-butyl phenol and about 0.1 to about 2.0 wt % of 2,6-di-t-butyl cresol in the ratio of about 1:1 to about 1:1.5.

In one embodiment of the invention the composition also includes a tolyltriazole metal deactivator represented by formula III. The preferred metal deactivator is 1, 2, 3 tolyltriazole, which is a reaction product of a benzotriazole and a diphenyl amine.

III

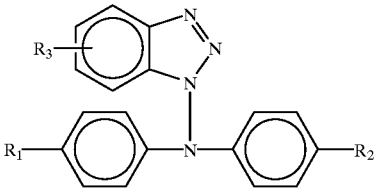

wherein $R_1$ and $R_2$ may be the same or different alkyl groups having from about 3 to about 15 and preferably about 4 to about 9 carbon atoms and $R_3$ is an alkyl group of from 1 to about 15 carbon atoms and preferably 1 carbon atom.

The metal deactivator typically will comprise from about 0.01 to about 1.5 wt % based on the weight of the paraffinic oil and preferably from about 0.10 to about 1.0 wt %, most preferably present at about 25% of the total treat of the phenolic compounds.

EXAMPLES

Two different batches of a typical paraffinic oil (Solvent Neutral 145) suitable for use as an electrical oil were blended with varying amounts of phenols represented by formula I and II. The specific amounts of the phenols used in each blend are given in Table 1. In two of the blends a metal deactivator used in electrical oil compositions was also used. The amount of metal deactivator also is given in Table 1.

TABLE 1

Effect of Phenolic and Metal Deactivator to Enhance Gassing Tendency

| | Blend 1 | Blend 2 | Blend 3 | Blend 4 | Blend 5 |
|---|---|---|---|---|---|
| Solvent Neutral 145 (A) | 98.69 | 98.79 | 98.75 | 98.45 | |
| Solvent Neutral 145 (B) | | | | | 98.45 |
| Phenol, (1), Formula I | 1.31 | | 0.50 | 0.50 | 0.50 |
| Phenol, (2), Formula II | | 1.21 | 0.75 | 0.75 | 0.75 |
| Metal Deactivator, (3) Formula III | | | | 0.30 | 0.30 |
| Gassing Tendency | 2.7 | 3.0 | 0.7 | 0.1 | −4.2 |

notes:
A and B are two different but typical batches of Solvent Neutral 145
(1) 2,6-di-tert-butyl phenol
(2) 2,6-di-tert-butyl cresol
(3) metal deactivator is tolyltriazole diphenyl amine reaction product From the foregoing it can be seen that the combined phenol anti-oxidants are more effective in reducing gassing than either anti-oxidant alone at the molar concentration. It can be seen also that the inclusion in the blend of the metal deactivator further lowers the gassing tendency of the blended oil, and in one case can provide negative gassing tendency to the oil.

What is claimed is:

1. A method for inhibiting the gassing tendency of a paraffinic or naphthenic electrical oil comprising adding to the oil the combination of at least one phenol represented by formula 1

I

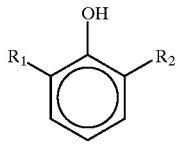

and at least one phenol represented by formula II

II

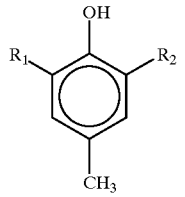

where $R^1$ and $R_2$ may be the same or different alkyl groups containing 3 to about 9 carbon atoms, the combination being added in an amount greater than 0.5 wt % based on the weight of oil and wherein the weight ratio of the phenol of formula I to I is in the range of 1:10 to 10:1.

2. The method of claim 1 wherein the combination is present in an amount ranging from about 1.0 to about 1.5 wt %.

3. The method of claim 2 wherein the ratio of phenols of formula I to formula II is from 1:1 to 1:1.5 respectively.

4. The method of claim 3 including adding to the oil a metal deactivator having the formula

III

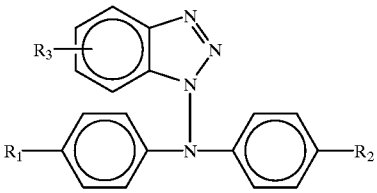

wherein $R^1$ and $R^2$ may be the same or different alkyl groups having from about 3 to about 15 carbon atoms and $R_3$ is an alkyl group of from 1 to about 15 carbon atoms.

5. The method of claim 4 wherein the metal deactivator comprises from about 0.01 to about 1.5 wt % based on the weight of the oil.

6. The method of claim 4 wherein the metal deactivator is present at about 25% of the total amount of the phenols.

* * * * *